US011738990B2

(12) United States Patent
Brown et al.

(10) Patent No.: US 11,738,990 B2
(45) Date of Patent: Aug. 29, 2023

(54) ULLAGE FLOAT ASSEMBLY FOR FUEL TANK AND METHODS OF USE

(71) Applicant: Whitecap Industries, Inc., Piscataway, NJ (US)

(72) Inventors: Christopher Brown, Jupiter, FL (US); Du Sing-Long, Taipei (TW); Todd Moore, St. Paul, MN (US); Christopher E. Tomao, Robbinsville, NJ (US)

(73) Assignee: WHITECAP INDUSTRIES, INC., Piscataway, NJ (US)

( * ) Notice: Subject to any disclaimer, the term of this patent is extended or adjusted under 35 U.S.C. 154(b) by 0 days.

(21) Appl. No.: 17/839,933

(22) Filed: Jun. 14, 2022

(65) Prior Publication Data

US 2022/0402747 A1 Dec. 22, 2022

Related U.S. Application Data

(60) Provisional application No. 63/211,137, filed on Jun. 16, 2021.

(51) Int. Cl.

| | |
|---|---|
| ***B67D 7/32*** | (2010.01) |
| ***B67D 7/04*** | (2010.01) |
| ***B63B 17/00*** | (2006.01) |

(52) U.S. Cl.

CPC ..... *B67D 7/3209* (2013.01); *B63B 17/0027* (2013.01); *B67D 7/04* (2013.01); *B67D 7/3227* (2013.01)

(58) Field of Classification Search

CPC ..... B67D 7/04; B67D 7/3209; B67D 7/3227; B63B 17/0027

USPC ..... 141/198

See application file for complete search history.

(56) References Cited

U.S. PATENT DOCUMENTS

| | | | | |
|---|---|---|---|---|
| 5,313,977 | A * | 5/1994 | Bergsma | F16K 17/363 137/202 |
| 5,348,177 | A * | 9/1994 | Sung | B60K 15/04 220/86.2 |
| 5,458,168 | A * | 10/1995 | Lindgren | B67C 11/066 141/DIG. 1 |
| 5,630,452 | A * | 5/1997 | Schmid | B67C 11/02 141/331 |
| 5,931,327 | A * | 8/1999 | Sung | B60K 15/04 277/607 |
| 6,405,766 | B1 * | 6/2002 | Benjey | F16K 24/044 141/303 |
| 6,597,998 | B1 | 7/2003 | Gonring | |
| 7,147,017 | B2 * | 12/2006 | Leonhardt | F16K 24/044 141/303 |

(Continued)

FOREIGN PATENT DOCUMENTS

| | | |
|---|---|---|
| CN | 102003493 A | 4/2011 |
| CN | 102656084 A | 9/2012 |

(Continued)

*Primary Examiner* — Timothy L Maust

(74) *Attorney, Agent, or Firm* — Servilla Whitney LLC

(57) ABSTRACT

Ullage float assemblies for fuel tanks are disclosed including a guide member with a retaining element mounted to a valve body which includes a first valve port and a second valve port in fluid communication. Methods of preventing spillage of fuel from a fuel tank during a refueling and a diurnal fuel volumetric expansion event are also disclosed. The assemblies and methods.

18 Claims, 5 Drawing Sheets

(56) References Cited

U.S. PATENT DOCUMENTS

| | | | | |
|---|---|---|---|---|
| 7,178,512 | B1 | 2/2007 | Merten | |
| 7,225,826 | B2 | 6/2007 | Riviezzo | |
| 7,422,027 | B2 | 9/2008 | Riviezzo | |
| 7,584,766 | B2 * | 9/2009 | David | F16K 31/18 137/433 |
| 7,757,728 | B2 * | 7/2010 | Gruber | B67C 11/066 141/344 |
| 8,100,153 | B2 * | 1/2012 | Hirata | F16K 31/22 141/95 |
| 8,360,089 | B2 * | 1/2013 | Hirata | F02M 37/0023 137/202 |
| 8,464,764 | B1 * | 6/2013 | Milsom | B60K 15/03519 137/202 |
| 8,602,362 | B2 | 12/2013 | Buchwald | |
| 8,807,160 | B2 | 8/2014 | Monterrey | |
| 8,826,947 | B2 * | 9/2014 | Hirose | B60K 15/035 141/95 |
| 9,316,354 | B2 | 4/2016 | Bostwick, IV | |
| 9,453,583 | B1 | 9/2016 | Boucher, II | |
| 9,605,803 | B2 | 3/2017 | Bostwick, IV et al. | |
| 9,869,281 | B2 | 1/2018 | Cai et al. | |
| 9,995,260 | B2 | 6/2018 | Abd Elhamid et al. | |
| 10,975,740 | B2 * | 4/2021 | Daniel | F01M 11/04 |
| 2009/0301583 | A1 | 12/2009 | Mills et al. | |
| 2010/0096491 | A1 | 4/2010 | Whitelaw et al. | |
| 2016/0097348 | A1 | 4/2016 | Abd Elhamid et al. | |
| 2019/0170561 | A1 | 6/2019 | Manabe et al. | |
| 2020/0031500 | A1 | 1/2020 | Russell | |

FOREIGN PATENT DOCUMENTS

| | | | |
|---|---|---|---|
| CN | 106235381 | A | 12/2016 |
| CN | 206043405 | U | 3/2017 |
| CN | 106678541 | A | 5/2017 |
| CN | 108139026 | A | 6/2018 |
| CN | 109339992 | A | 2/2019 |
| CN | 109789343 | A | 5/2019 |
| CN | 110945277 | A | 3/2020 |
| EP | 2048079 | B1 | 12/2019 |
| KR | 20110005678 | A | 1/2011 |
| WO | 2009052035 | A1 | 4/2009 |
| WO | 2010014753 | A2 | 2/2010 |

* cited by examiner

ULLAGE FLOAT ASSEMBLY FOR FUEL TANK AND METHODS OF USE

CROSS-REFERENCE TO RELATED APPLICATION

This application claims priority to U.S. Provisional Application No. 63/211,137, filed Jun. 16, 2021, the entire disclosures of which are hereby incorporated by reference herein.

TECHNICAL FIELD

The present disclosure relates to ullage float assemblies and methods that facilitate the refilling and ventilation of fuel tanks, and in particular, fuel tanks used in marine applications.

BACKGROUND

The present disclosure relates generally to fuel tanks, and more particularly to fuel tanks installed in watercraft, such as ships, yachts, boats, personal watercraft (PWC, e.g., JETSKI® and SEADOO®). More specifically, the disclosure relates to assemblies for and methods of controlling spillage of fuel and ventilation of vapors from fuel tanks, and in particular, watercraft fuel tanks.

Due to environmental concerns, boat fuel tanks are federally regulated and are required eliminate the propensity for raw fuel or vapor from exiting the fuel tank and fuel system into to a waterway (i.e., river, lake, stream, ocean, etc.) and the atmosphere. An Environmental Protection Agency (EPA) regulation requires a controlled filling process to prevent "spitting back" raw fuel into the vessel or into the waterway. Accordingly, boat operators and personnel who fill watercraft fuel tanks must be able to fill the fuel tank without fuel "spitting back" from the tank or spilling.

The marine industry adopted automotive (cars and trucks) technology, and a typical assembly includes a Fluid Limit Vent Valve (FLVV) installed on the tank, and a flapper style check valve installed on the fuel inlet hose just above the tank. During filling, as fuel rushes into the tank, air that is displaced runs out through the FLVV. When the fuel reaches the maximum fill level, the FLVV closes, shutting off airflow. At this point, the fuel backs up the fill hose and trips the aspirator on the nozzle to shutoff. The check valve prevents fuel in the tank from backing up the fill hose, onto the vessel, or into the waterway. Spitback is prevented by designing the assembly to maintain an expansion or ullage space within a fuel tank. The space required for gasoline expansion at elevated temperatures is at or about 5% by volume for the tank.

Unlike automotive fuel tanks, which have a more finite number of sizes, shapes and mounting configurations, watercraft fuel tank have a much wider variety of sizes and shapes along with how and where a fuel tank is mounted on the watercraft. In addition, recreational watercraft experience angular attitudes during in water refueling, boating activities, adverse weather conditions and storage. Existing fuel tank ullage assemblies utilize floating balls or captured floats in tube or a cylindrical cage that rely on the placement of the ullage float valve seats to determine ullage space in a fuel tank, however, these existing assemblies are limited to certain fuel tank configurations, smaller relative capacities and are primarily rectangular in configuration. Because of these factors, a much greater number of ullage float assembly sizes and configurations are required for watercraft compared to automotive ullage float assemblies.

Accordingly, there is a need for ullage float assemblies and methods that can be readily adapted for all watercraft fuel tank configurations and addresses all refueling, in-use fuel and vapor management considerations.

SUMMARY

One or more embodiments of the disclosure are directed to a fuel assembly ullage float assembly comprising a guide member having a first end and a second end, where at least the first end has a retaining element; a valve body including a first valve port and a second valve port in fluid communication and defining an inner sidewall and an outer sidewall, the second valve port including a flared receptacle and a valve seat, the flared receptacle including a diameter that decreases from a lower portion of the flared receptacle to the valve seat, the second end of the guide member mounted to the valve body; and an ullage float slidably mounted on the guide member between the retaining element and the valve seat, the ullage float having a height H and a stepped outside surface including an upper portion having a diameter D1 and a lower portion having a diameter that is greater than the diameter D1, the ullage float including a sealing ledge that is configured to seal against the valve seat.

A second embodiment of the of the disclosure are directed to an ullage float assembly comprising a guide member having a first end and a second end, where the first end has a retaining element; a valve body including a first valve port in fluid communication with at least one of incoming air, exiting air, fuel, fuel vapor and incoming fuel and a second valve port in fluid communication and defining an inner sidewall and an outer sidewall, the second valve port including a receptacle and a valve seat, the second end of the guide member mounted to the valve body; and an ullage float slidably mounted on the guide member between the retaining element and the valve seat, the ullage float comprising an elastomeric foam body having a height H and an outside surface configured to seal against the valve seat.

A second aspect of the disclosure pertains to a method of preventing spillage of fuel from a fuel tank during a refueling and a diurnal fuel volumetric expansion event. A method comprising mounting an ullage fuel float valve to a wall, for example, an upper or top wall, of a fuel tank, the ullage fuel float valve comprising a fuel inlet port and a fuel outlet port in fluid communication and a slidably mounted ullage fuel float configured to rise as fuel is added to the fuel tank and fall as fuel exits the fuel tank; mounting an ullage vent float valve to a wall, for example, an upper or top wall, of a fuel tank, the ullage vent float valve comprising an ullage vent port and an air inlet port in fluid communication and an ullage vent float configured to rise as diurnally heated volumetric expansion occurs or as fuel is added to the fuel tank and fall as fuel diurnally shrinks or exits the fuel tank; and filling the fuel tank with a refueling nozzle, and when the fuel tank reaches a predetermined fill level, the ullage vent float terminates flow of vapor through the ullage vent port and backpressure generated in the fuel tank, drives incoming raw fuel back up the up the fuel inlet port and refueling nozzle, shuts off the refueling nozzle and prevents spillage of fuel from a fuel tank.

DETAILED DESCRIPTION

Figure 1:
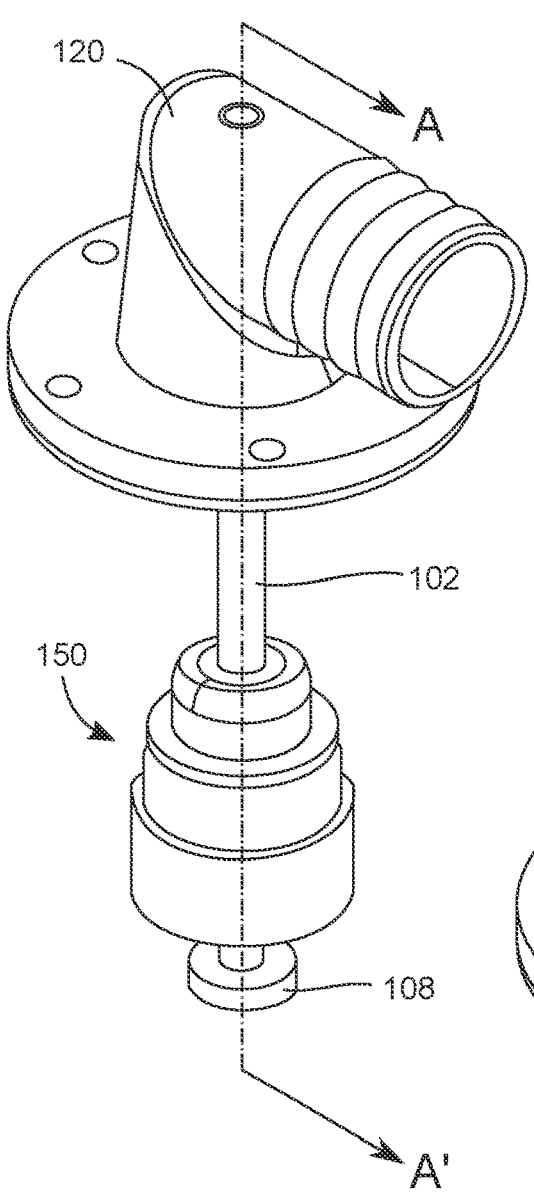
FIG. 1 is a front isometric of an ullage float assembly with an ullage float in a first position.
Figure 2:
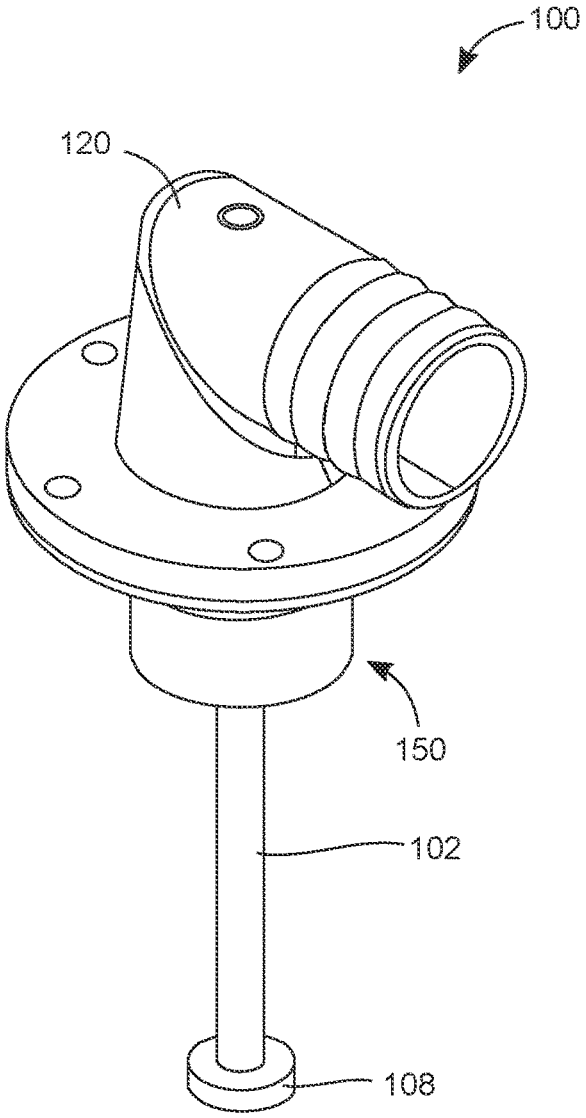
FIG. 2 is a front isometric of the ullage float assembly of FIG. 1 showing the ullage float in a second position.

Before describing several exemplary embodiments of the disclosure, it is to be understood that the disclosure is not limited to the details of construction or process steps set forth in the following description. The disclosure is capable of other embodiments and of being practiced or being carried out in various ways.

With respect to terms used in this disclosure, the following definitions are provided.

As used herein, the use of "a," "an," and "the" includes the singular and plural.

Embodiments of the disclosure provide ullage float assemblies and methods that are configured to initiate a refueling shut off event and substantially reduce and/or eliminate spit-back from a wide variety of watercraft fuel tanks as required by EPA regulations. Embodiments of the disclosure provide disclosure provide ullage float assemblies and methods that facilitate the refilling and proper ventilation of a fuel tank. One or more embodiments of ullage float assemblies and methods provide one or more of the following features: simple in design, easy to manufacture, reliable, low cost, resistant to fuel permeation and safer for the environment than existing assemblies and methods. Embodiments of the ullage float assemblies and methods also eliminate an enclosure or cage that is used in existing assembly to enclose or surround the float, which render existing assemblies unduly complex and require a check valve.

A first aspect of the disclosure pertains to an ullage float assembly 100 for a fuel system, for example a marine watercraft fuel system. In one embodiment with reference to FIGS. 1-5B, an ullage float assembly 100 for a fuel system is shown comprising a guide member 102 having a first end 104 and a second end 106, where at least the first end 104 has a retaining element 108. The retaining element 108 can be permanently affixed to the guide member 102, for example by welding, or the retaining element 108 can be removably affixed to the guide member 102, for example, using a threaded connection. The guide member 102 in some embodiments is a rod, which can be hollow or solid.

The ullage float assembly 100 further comprises a valve body 120 including a first valve port 122 and a second valve port 124 in fluid communication and defining an inner sidewall 126 and an outer sidewall 128. In the embodiment shown, the first valve port 122 and the second valve port 124 are at a right angle (90 degree angle) to each other, but this configuration is nonlimiting. In some embodiments, the first valve port 122 and the second valve port 124 are at angles that are not at a 90 degree angle to each other. The first valve port 122 includes a flared receptacle 130 and a valve seat 132, the flared receptacle 130 including a diameter $D_f$ that decreases from a lower section 134 of the flared receptacle 130 to the valve seat 132. The second end 106 of the guide member 102 is mounted to the valve body 120. The second end 106 can be mounted by a threaded connection, a compression fitting or any other suitable connection. The valve body 120 further comprises a flange 107 that extends from the valve body and a gasket 105 is sandwiched between the valve body and a wall 103 of a fuel tank 101. It will be appreciated that only a portion of the wall 103 of the fuel tank 101 is shown, namely an upper or top wall as shown.

The ullage float assembly 100 further comprises an ullage float 150 slidably mounted on the guide member 102 between the retaining element 108 and the valve seat 132, the ullage float 150 having a height H and a stepped outside surface 152 including an upper portion 154 having a diameter D1 and a lower portion 158 having a diameter that is greater than the diameter D1, the ullage float 150 including a sealing ledge 160 that is configured to seal against the valve seat 132. It will be appreciated that diameter D1 is less than the diameter $D_f$ of the lower section 134 of the flared opening 134.

In one or more embodiments of the disclosure, the ullage float 150 further includes an intermediate portion 156 disposed between the lower portion 158 and the upper portion 154, the intermediate portion 156 having a diameter D2 and the lower portion 158 having a diameter D3 such that D3 is greater than D2 and D2 is greater than D1 and the sealing ledge 160 is located at a transition surface 164 from the intermediate portion 156 and the upper portion 154. In some embodiments, the diameter D2 is less than the diameter $D_f$ of the lower section 134 of the flared opening 134.

In one or more embodiments of the disclosure, the intermediate portion 156 of the ullage float 150 valve is configured to fit within the flared receptacle 130 of the valve body 120 and to contact the valve seat 132 in the valve body 120 at the second valve port 124. The upper portion 154 is configured to fit within the inner sidewall 126 of the valve body 120 at the second valve port 124. The lower portion 158 facilitates motion of ullage float 150 to moveably slide along the guide member 102.

In one or more embodiments of the disclosure, the ullage float 150 assembly 100 further includes a float gasket 166 disposed around the upper portion 154 of the ullage float 150 and seated on a transition surface 164 from the intermediate portion 156 of the ullage float 150 to the upper portion 154, the float gasket 166 configured to form a fluid seal between the ullage float 150 with the valve seat 132 to terminate fluid communication between the first valve port 122 and the second valve port 124 when the ullage float 150 is pushed against the valve seat 132 when the fuel tank 101 is at a predetermined level during fueling or a diurnal fuel volumetric expansion event to prevent fuel spillage. In some embodiments of the disclosure, the upper portion 154 of the ullage float 150 has a groove 168 adjacent to the intermediate portion 156 to provide the float gasket 166 with an interference fit to hold the float gasket 166 on the ullage float 150 and to prevent the float gasket 166 from inadvertently sliding off the ullage float 150. In some embodiments of the disclosure, the upper portion 154 also includes a rounded edge 170 to promote smooth engagement of upper portion 154 of ullage float 150 fitting within inner sidewall 126. Rounded edge 170 of upper portion 154 also provides convenient installation of a replacement float gasket 166 to be fitted into the groove 168 upon such event.

In one or more embodiments of the disclosure, ullage float 150 is comprised of a fuel-resistant and non-swelling material selected from an elastomer and a rubber. In another aspect of the embodiment, the fuel-resistant and non-swelling material is selected from the group consisting of a nitrile butadiene and a fluoropolymer elastomer. In another aspect of the embodiment, the fuel-resistant and non-swelling material is selected from the group consisting of a gas-filled nitrile butadiene and a gas-filled fluoropolymer elastomer.

In an exemplary embodiment of the disclosure, the fuel-resistant and non-swelling material is selected from the group consisting of a gas-filled, closed pore nitrile butadiene and a gas-filled closed pore fluoropolymer elastomer. Combined with the dimensions of the lower float of ullage float 150, the gas-filled closed pore fluoropolymer elastomer provides sufficient buoyancy with fuel to exert a force on the ullage float 150 great enough to slidably move ullage float 150 along guide member 102 and push against the valve seat 132 on the valve body 120 to terminate fluid communication between the first valve port 122 and second valve port 124. Appropriate fluoropolymer elastomer material that can be used for the ullage float 150 includes Viton®, available from E.I. du Pont de Nemours & Company, or other equivalents with similar properties of fluoropolymer elastomer materials.

In some embodiments of the disclosure, the upper portion 154, intermediate portion 156, and lower portion 158 of the ullage float 150 may be slightly tapered to improve flow of fuel when passing through the ullage float 150 valve assembly and into the fuel tank 199 or to better engage with the flared receptacle 130 of the valve body 120.

In other embodiments of the disclosure, the ullage float 150 is configured to movably slide along the guide member 102 when an amount of fuel causes floatation lift of the guide member 102 in the fuel tank 199. The ullage float 150 gets lifted upwards towards the second end 106 of the guide member 102 as the fuel fill line 195 increases within in a fuel tank 199. Alternatively, the ullage float 150 moves downwards towards the first end 104 of the guide member 102 when the fuel fill line 195 in a fuel tank 199 decreases.

In one or more embodiments of the disclosure the guide member 102 comprises a rod, and the ullage float 150 comprises a track 172 configured to permit the ullage float 150 to move along the guide member 102. The track 172 can comprise a central opening running along a length of the ullage float, sized and shaped to allow the ullage float 150 to freely slide on the guide member 102. In one or more embodiments of the disclosure, the second end 106 of the guide member 102 is mounted to the valve body 120 for assembly and to reduce sway in the guide member 102. In an exemplary embodiment of the disclosure, the guide member 102 is welded to the inner sidewall 126 of the valve body 120. In another embodiment of the disclosure, the first end 104 of the guide element can be threaded to mechanically fasten to the inner sidewall 126 of valve body 120. In one or more embodiments of the disclosure, the guide member is parallel with the first valve port 122 to facilitate engagement between the sealing ledge 160 of the ullage float 150 to the valve seat 132 within the first valve port 122.

In another embodiment of the disclosure, the guide member 102 comprises of a fuel-resistant and non-corrosive material. In one or more embodiments of the disclosure, the material of the guide member 102 is selected from a group that includes but is not limited to: aluminum and aluminum alloys, copper and copper alloys, titanium and titanium alloys, nickel alloys, Iron, steel, stainless steels and other metals with appropriate fuel-resistance and non-corrosive properties widely used in the marine industry.

In one or more embodiments of the disclosure, a retaining element 108 on the first end 104 of the guide member 102, the retaining element 108 configured to hold the ullage float 150 on the guide member 102. In other embodiments of the disclosure, the retaining element 108 can include a retaining ring, E-Clips, push nut, threaded nut, a washer, or similar retaining devices. In some embodiments of the disclosure, the second end 106 of the guide element can be threaded to receive a threaded nut to use as a retaining element 108. In other embodiments of the disclosure, the second end 106 of the guide element can have a slot (not shown) to receive retaining rings, E-clips, or push nuts. In another embodiment of the disclosure, any object sufficient to reliably attach to the first end 104 of the guide member 102 and hold the ullage float 150 on the guide can be utilized as a retaining element 108.

A second embodiment of the disclosure pertains to an ullage float assembly 100 for a fuel system. In one embodiment with reference to FIGS. 1-5, an ullage float assembly 100 100 for a fuel system is shown comprising a guide member 102 having a first end 104 and a second end 106, where the first end 104 has a retaining element 108.

The ullage float assembly 100 further comprises a valve body 120 including a first valve port 122 in fluid communication with at least one of incoming air, exiting air, fuel, fuel vapor and incoming fuel and a second valve port 124 in fluid communication and defining an inner sidewall 126 and an outer sidewall 128, the second valve port 124 including a receptacle 130 and a valve seat 132, the second end 106 of the guide member 102 mounted to the valve body 120; and The ullage float assembly 100 further comprises an ullage float 150 slidably mounted on the guide member 102 between the retaining element 108 and the valve seat 132, the ullage float 150 comprising an elastomeric foam body having a height H and an outside surface configured to seal against the valve seat 132. In one or more embodiments of the disclosure, the ullage fuel float comprises a gas-filled, closed cell butadiene.

In one or more embodiments of the disclosure, the receptacle 130 comprises flared receptacle 130 including a diameter that decreases from a lower section 134 of the flared receptacle 130 to the valve seat 132 and the outside surface of the ullage float 150 including a stepped surface including an upper portion 154 having a diameter D1 and a lower portion 158 having a diameter that is greater than the diameter D1, the ullage float 150 including a sealing ledge 160 that is configured to seal against the valve seat 132, the ullage float assembly 100 configured to prevent spillage of fuel from a fuel tank 199 during fueling or a diurnal fuel volumetric expansion event.

Figure 6:
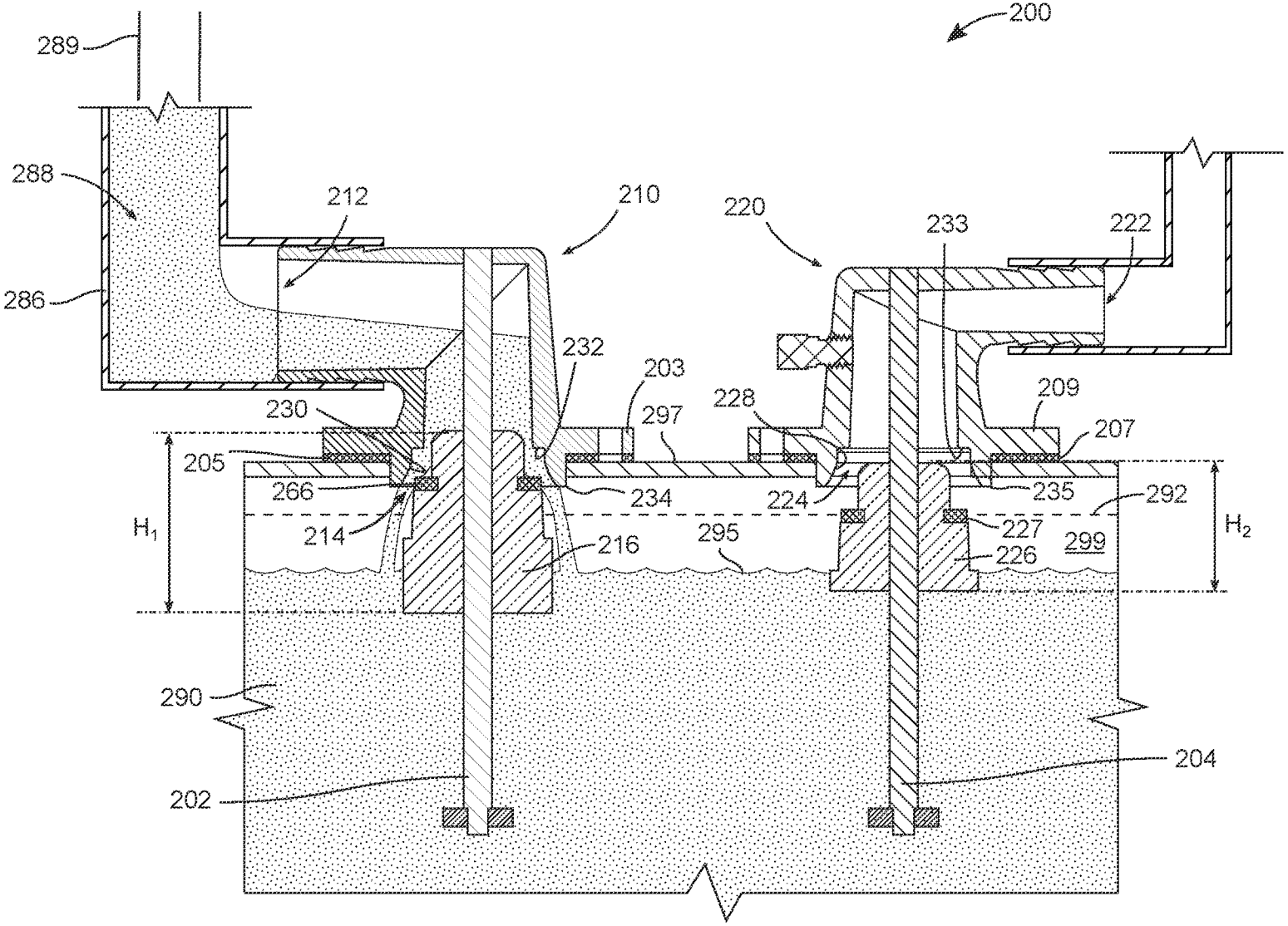
FIG. 6 is a cross-sectional view of an ullage float assembly integrated with a fuel tank during fuel prior to fuel reaching a predetermined level according to an embodiment of the disclosure.
Figure 7:
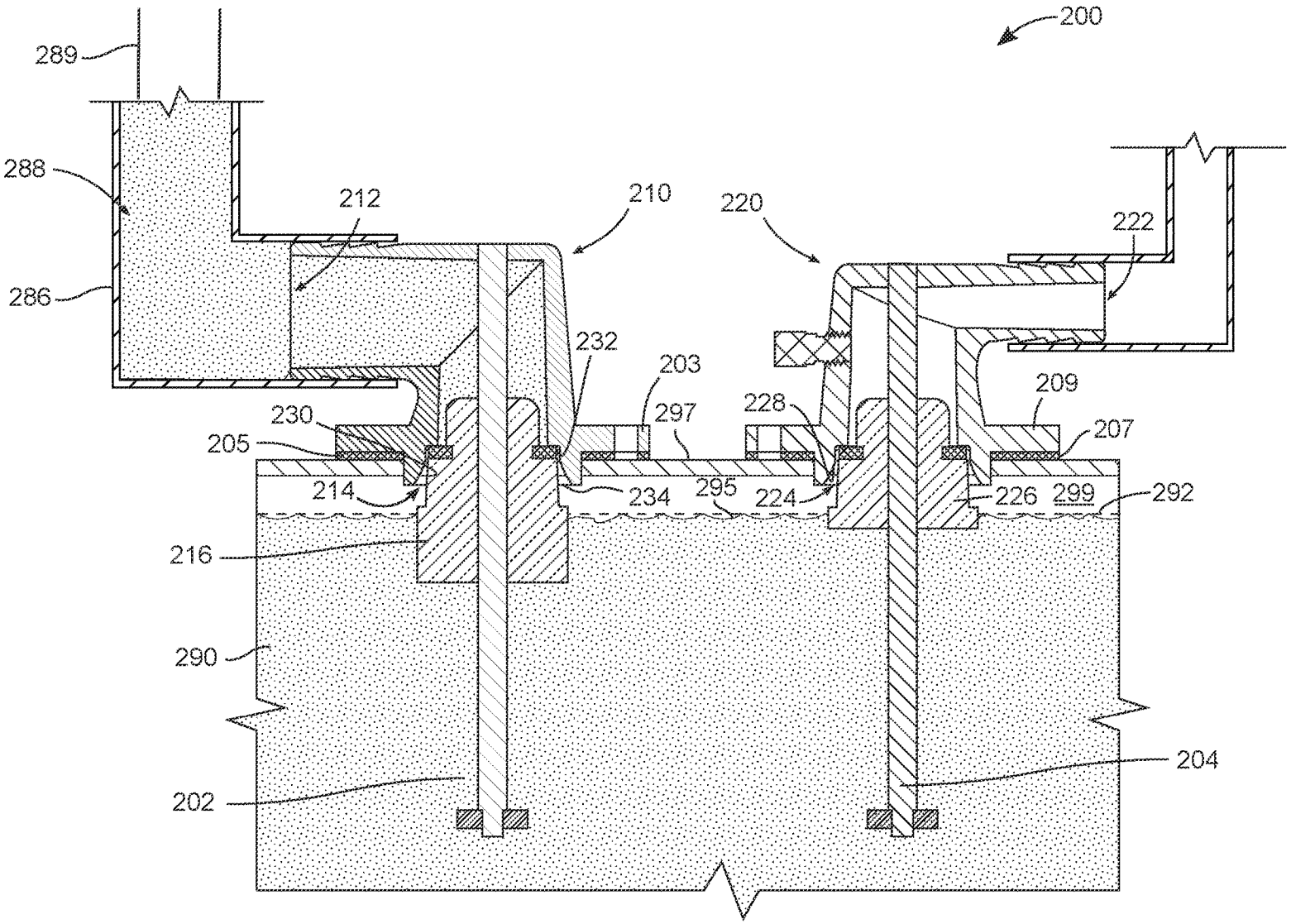
FIG. 7. is a cross-sectional view of the ullage float assembly integrated with a fuel tank shown in FIG. 6 when the fuel has reached the predetermined level.

Referring now to FIGS. 6 and 7, an embodiment of a fuel ullage assembly for preventing spillage of fuel 290 from a fuel tank 299 during a refueling and a diurnal fuel volumetric expansion event is shown. In FIG. 6 the fuel ullage float assembly integrated with a fuel tank is shown during fueling and prior to fuel reaching a predetermined level. In FIG. 7, the ullage float assembly integrated with a fuel tank shown in FIG. 6 when the fuel has reached the predetermined level.

Referring now to FIGS. 6-7, an ullage fuel system 200 is shown, which can be used in a method of preventing spillage of fuel 290 from a fuel tank 299 during a refueling and a diurnal fuel volumetric expansion event is shown. The ullage fuel system 200 has an ullage fuel valve 210 mounted to a wall, and in the embodiment shown, an upper wall or a top wall 297 of a fuel tank 299. There is a first gasket 205 between the top wall 297 and a flange 203 of the ullage fuel valve 210. The ullage fuel valve 210 comprises a fuel inlet port 212 and a fuel outlet port 214 in fluid communication with each other. As shown, incoming fuel 288 flows from the fuel inlet port 212 and out of the fuel outlet port 214 and into the fuel tank 299. A slidably mounted ullage fuel float 216 is mounted to a guide member 202 similar to the way described above with respect to FIGS. 1-5A-B. The ullage fuel float 216 is configured to rise as fuel 290 is added to the fuel tank 299 and fall as tank fuel 290 exits the fuel tank 299.

The ullage vent valve 220 is mounted to a wall, in particular, an upper wall or the top wall 297 of the fuel tank 299 with a second gasket 207 between the top wall 297 and a flange 209 of the ullage vent valve 220. The ullage vent valve 220 comprises an air outlet port 222 and an air inlet port 224 in fluid communication and an ullage vent float 226 slidably mounted to a second guide member 204. The ullage vent float 226 is configured to rise as diurnally heated volumetric expansion occurs or as incoming fuel 288 is added to the fuel tank 299 causing the tank fuel 290 level to rise and fall as the tank fuel 290 diurnally reduces in volume or exits the fuel tank 299 during use of fuel to power an engine.

In use, during filling of the fuel tank 299 with a refueling nozzle 289 as shown in FIG. 6, the slidably mounted ullage fuel float 216, having a height H1 greater than the ullage vent float 226 height H2, is lifted due to buoyancy of the ullage fuel float 216 in the rising fuel level towards the ullage valve seat 232. The ullage fuel float 216 rises due to buoyancy, which causes the float gasket 266 to make contact with the ullage valve seat 232, however, there is insufficient lift of the ullage fuel float 216 to effectively cause valve closure of ullage fuel valve 210. When the tank fuel 290 in the fuel tank 299 reaches a predetermined fill level 292, the ullage vent float 226 rises and causes the vent gasket 227 to contact and firmly seal against a vent valve seat 233, the contact and firm seal sufficient to terminate flow of vapor through the ullage vent valve 220. In one or more embodiments, the predetermined fill level is 95% of the volume capacity of the fuel tank. The firm seal of the ullage vent float and vent gasket 227 against the vent valve seat 233 causes increasing backpressure in the fuel tank 299 to further lift the ullage fuel float 216 against the ullage valve seat 232 to firmly seal the float gasket 266 and the ullage valve seat 232, to effectively cause closure of ullage fuel valve 210 and to terminate flow of incoming fuel 288 as shown in FIG. 7.

The closure of the ullage fuel valve 210 due to the backpressure generated in the fuel tank 299 causes incoming fuel 288 to fill up the fill hose line 286 and cause shut off the refueling nozzle to prevent spillage of the tank fuel 290 from the fuel tank 299. In one or more embodiments, the ullage fuel float 216 having a configuration similar to the ullage float 150 shown in FIGS. 4 and 5A-B has a float gasket 266 at the upper portion of the ullage fuel float 216, and the float gasket 266 seats against the ullage valve seat 232.

In an embodiment of the disclosure, terminating flow of vapor through the ullage vent valve 220 occurs prior to the closure of the ullage fuel valve 210 which is caused by backpressure generated in the fuel tank 299. This drives incoming fuel 288 upward in the fill hose line 286 to causes refueling liquid fuel to actuate common aspirator valve (not shown) of the refueling nozzle, which is the typical shut off operation of the refueling event.

Figure 3:
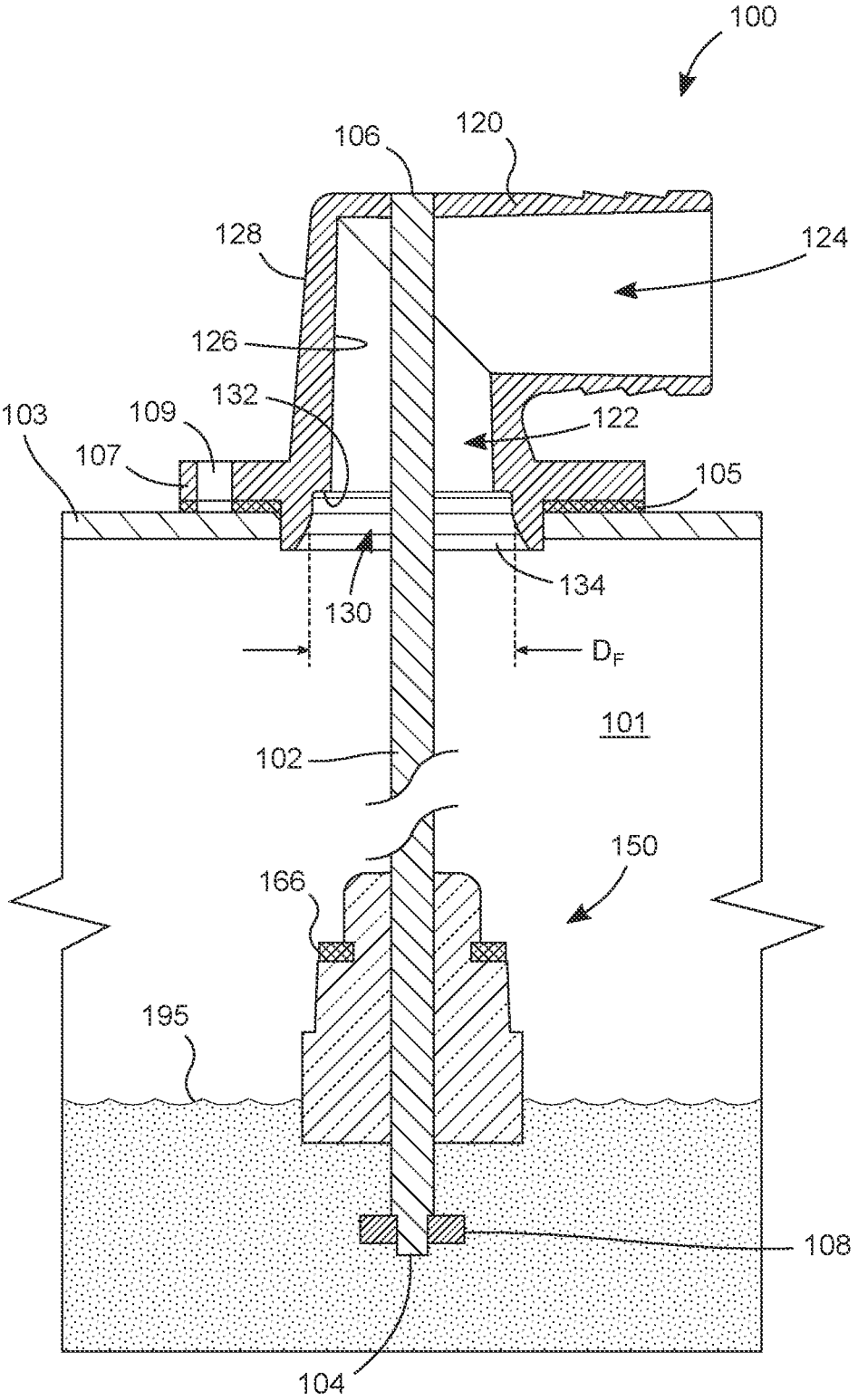
FIG. 3 is a cross-sectional view of an ullage float assembly taken along line A-A' of FIG. 1 and integrated with a fuel tank in one embodiment of the disclosure.
Figure 4:
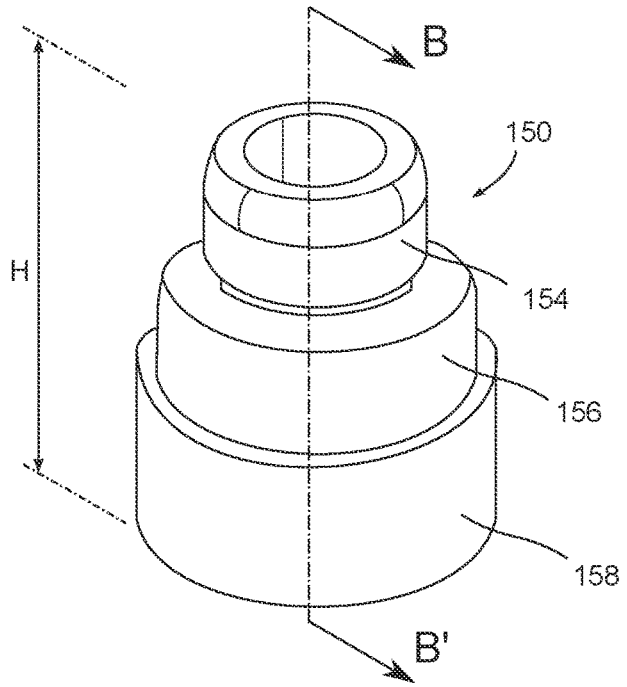
FIG. 4 is a perspective view of an ullage float.
Figure 5A:
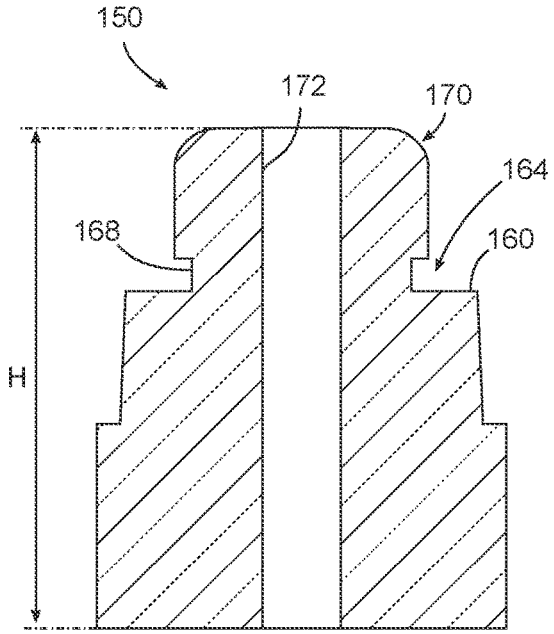
FIG. 5A is a cross-sectional view of an ullage float taken along line B-B' of FIG. 4.
Figure 5B:
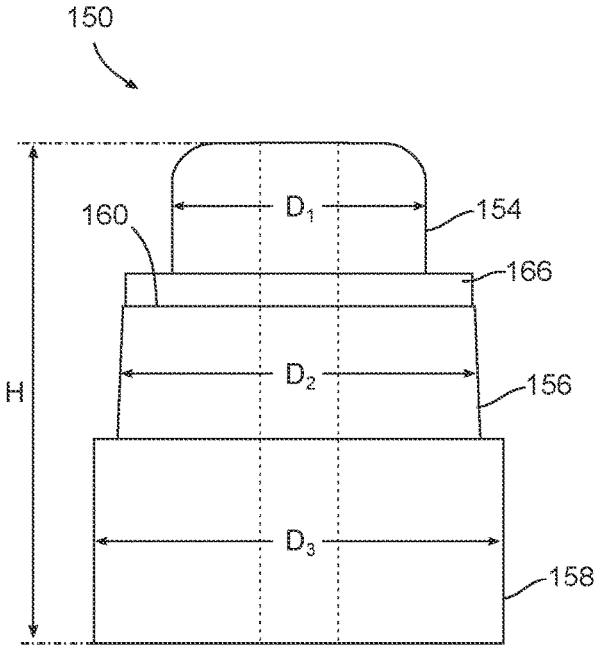
FIG. 5B is a front side view of an ullage float.

In one or more embodiments of the disclosure, the fuel outlet port 214 includes a flared receptacle 230 and the ullage valve seat 232, the flared receptacle 230 including a diameter that decreases from a lower portion 234 of the flared receptacle 230 to the ullage valve seat 232, similar to the configuration of the valve body shown in FIG. 3. The ullage fuel float 216 has a stepped configuration and a height H1, the ullage fuel float 216 slidably mounted to a guide member 202, similar to the embodiment shown in FIGS. 1-5A-B. In some embodiments of the disclosure, the flared receptacle 230 and the ullage valve seat 232 is in the uppermost practical level in the fuel tank 299. In one or more embodiments of the disclosure, the geometry of the fuel tank 299 and the fuel tank 299 volume is used to determine the height H1.

In one or more embodiments of the disclosure, the air inlet port 224 includes a flared receptacle 228 and the vent valve seat 233, the flared receptacle 228 including a diameter that decreases from a lower portion 235 of the flared receptacle 228 to the vent valve seat 233, similar to the configuration of the valve body shown in FIG. 3. The ullage vent float 226 has a stepped configuration and a height H2, the ullage vent float 226 slidably mounted to a guide member 204, similar to the embodiment shown in FIGS. 1-5A-B. In some embodiments of the disclosure, the flared receptacle 228 and the vent valve seat 233 is in the uppermost practical level in the fuel tank 299. In one or more embodiments of the disclosure, the geometry of the fuel tank 299 and the fuel tank volume is used to determine the height H2.

In one or more embodiments of the disclosure, the geometry of the fuel tank 299 and the fuel tank volume is used to determine the height H2. In an exemplary embodiment of the disclosure, fuel float height H1 is greater than vent float height H2 to enhance backpressure functionality and facilitate shut off operation of fuel nozzle and prevent spit-back from occurring. The configuration or overall geometry of ullage fuel float 216 is the same or similar to the ullage vent float 226 as shown in FIGS. 6 and 7.

In one or more embodiments, the respective heights of the vent float H2 and fuel float H1 are determined by the volume and geometry of a fuel tank 299. In an exemplary embodiment of the disclosure, the respective heights of the vent float H2 and fuel float H1 can be adjusted along with assembly clearances to attenuate and dissipate backpressure to achieve a desired vapor/ullage space after a non-spit back refueling event.

In one or more embodiments of the disclosure, the ullage valve seat 232 of the ullage fuel valve 210 and the vent valve seat 233 of the ullage vent valve 220 are at the same level with respect to each other, located at the uppermost practical level of the fuel tank 299. This is to ease method of manufacturing of ullage fuel system 200 and simplify installation of ullage fuel system on a fuel tank 299. The flange 203 of the ullage fuel valve 210 and the flange 209 are of the same diameter to secure the ullage fuel system 200 to a top wall 297 of a fuel tank 299.

In a more specific embodiment of the disclosure, the height H2 of the ullage vent float is calculated by obtaining the total volume of the fuel tank 299. The total volume is then multiplied by 95% to find the predetermined level 292 within the fuel tank 299. The length between the top wall 297 and the predetermined level 292 is used as the height H2 of the ullage vent float 226. Subsequently, the height H1 of the ullage fuel float 216 is determined by adding 0.5" to 2.0" to the height of H2. The additional height H2 of the ullage fuel float can vary depending on the geometry of the fuel tank 299.

In one or more embodiments of the disclosure, the fuel tank 299 has a fuel volume and shutting off the refueling occurs when the fuel tank 299 is filled to 95% of the fuel tank 299 volume, which is when the tank fuel 290 reaches the predetermined level 292.

In one or more embodiments of the disclosure, the ullage vent valve 220 may include an additional port as shown in FIGS. 6 and 7 to allow from diurnal venting of the fuel tank that is caused by angular tilting of a fuel tank installed on watercraft that may be in motion during use or on a trailer. The additional port may also serve to relieve or vent pressure buildup within the fuel tank in the event of a clogged vent pathway.

In one or more embodiments of the disclosure, the ullage vent valve 220 may include an air outlet port 222 that is smaller in diameter than the fuel inlet port 212 on the ullage fuel valve 210 as shown in FIGS. 6 and 7 as air pathways are generally smaller in diameter for fuel tank applications. In one or more embodiments of the disclosure, the ullage fuel float 216 comprises a gas-filled foam nitrile butadiene.

Although the disclosure herein has been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as disclosed.

What is claimed is:

1. An ullage float assembly for a fuel tank comprising:

a guide member having a first end and a second end;

a valve body including a first valve port and a second valve port in fluid communication and defining an inner sidewall and an outer sidewall, the first valve port including a flared receptacle and a valve seat, the flared receptacle including a diameter that decreases from a lower portion of the flared receptacle to the valve seat, the second end of the guide member mounted to the valve body; and an ullage float slidably mounted on the guide member comprising a hollow or solid rod between the first end and the valve seat, the ullage float having a height H and a stepped outside surface including an upper portion having a diameter D1, a lower portion having a diameter that is greater than the diameter D1, and an intermediate portion disposed between the lower portion and the upper portion, the intermediate portion configured to fit within the flared receptacle of the valve body and to contact the valve seat in the valve body, and the ullage float including a sealing ledge that is configured to seal against the valve seat.

2. The ullage float assembly of claim 1, the intermediate portion having a diameter D2 and the lower portion having a diameter D3 such that D3 is greater than D2 and D2 is greater than D1 and the sealing ledge is located at a transition surface from the intermediate portion and the upper portion.

3. The ullage float assembly of claim 2, further comprising a gasket disposed around the upper portion of the ullage float and seated on a transition surface from the intermediate portion of the ullage float to the upper portion, the gasket configured to form a fluid seal between the ullage float with the valve seat to terminate fluid communication between the first valve port and the second valve port when the ullage float is pushed against the valve seat.

4. The ullage float assembly of claim 3, wherein the ullage float is comprised of a fuel-resistant and non-swelling material selected from an elastomer and a rubber.

5. The ullage float assembly of claim 4, wherein the fuel-resistant and non-swelling material is selected from the group consisting of a nitrile butadiene and a fluoropolymer elastomer.

6. The ullage float assembly of claim 4, wherein the fuel-resistant and non-swelling material is selected from the group consisting of a gas-filled nitrile butadiene and a gas-filled fluoropolymer elastomer.

7. The ullage float assembly of claim 4, wherein the fuel-resistant and non-swelling material is selected from the group consisting of a gas-filled, closed pore nitrile butadiene and a gas-filled closed pore fluoropolymer elastomer.

8. The ullage float assembly of claim 1, wherein the ullage float is configured to movably slide along a guide member when an amount of fuel causes floatation lift of the guide member in the fuel tank.

9. The ullage float assembly of claim 8, wherein the ullage float comprises a track configured to permit the ullage float to move along the hollow or solid rod.

10. The ullage float assembly of claim 1, further comprising a retaining element on the first end of the guide member, the retaining element configured to hold the ullage float on the guide member.

11. An ullage float assembly comprising:

a guide member having a first end and a second end, the guide member comprising a hollow or solid rod;

a valve body including a first valve port in fluid communication with at least one of incoming air, exiting air, fuel, fuel vapor and incoming fuel and a second valve port in fluid communication and defining an inner sidewall and an outer sidewall, the first valve port including a receptacle and a valve seat, the second end of the guide member mounted to the valve body; and an ullage float slidably mounted on the guide member between the first end and the valve seat and configured to freely slide on the guide member by force provided buoyancy of fuel contained within a fuel tank when the ullage float is mounted to the fuel tank, the ullage float comprising an elastomeric foam body having a height H and an outside surface configured to seal against the valve seat, wherein the receptable comprises a flared receptacle including a diameter that decreases from a lower portion of the flared receptacle to the valve seat and the outside surface of the ullage float including a stepped surface including an upper portion having a diameter D1 and a lower portion having a diameter that is greater than the diameter D1, the ullage float including a sealing ledge that is configured to seal against the valve seat, the ullage float assembly configured to prevent spillage of fuel from a fuel tank during fueling or a diurnal fuel volumetric expansion event.

12. The ullage float assembly of claim 11, wherein the elastomeric foam body comprises a closed cell foam body selected from natural rubber, synthetic rubber and combinations thereof.

13. The ullage float assembly of claim 11, wherein ullage fuel float comprises a gas-filled, closed cell butadiene.

14. The ullage float assembly of claim 11, further comprising an ullage vent float valve mounted to a wall of a fuel tank, the ullage vent float valve comprising an ullage vent port configured to vent vapor from the fuel tank and an air inlet port in fluid communication and an ullage vent float configured to rise when diurnally heated volumetric expansion occurs or as fuel is added to the fuel tank and fall when fuel diurnally shrinks or exits the fuel tank.

15. A system for preventing spillage of fuel from a fuel tank during a refueling and a diurnal fuel volumetric expansion event comprising:

ullage fuel float valve slidably mountable to a guide member comprising a hollow or solid rod to a wall of a fuel tank, the ullage fuel float valve comprising a fuel inlet port and a fuel outlet port in fluid communication and a slidably mounted ullage fuel float configured to freely rise up the guide member as fuel is added to the fuel tank by force of buoyancy of the fuel and fall down the guide member as fuel exits the fuel tank;

an ullage vent float valve mountable to a wall of a fuel tank, the ullage vent float valve comprising an ullage vent port configured to vent vapor from the fuel tank and an air inlet port in fluid communication and an ullage vent float configured to rise when diurnally heated volumetric expansion occurs or as fuel is added to the fuel tank and fall when fuel diurnally shrinks or exits the fuel tank; and the system configured so that during filling of the fuel tank with a refueling nozzle, when the fuel tank reaches a predetermined fill level, the ullage vent float terminates flow of vapor through the ullage vent port and back-pressure generated in the fuel tank shuts off the refueling nozzle and prevents spillage of fuel from a fuel tank.

16. The system of claim 15, wherein the fuel outlet port includes a flared receptacle and a valve seat, the flared receptacle including a diameter that decreases from a lower portion of the flared receptacle to the valve seat, and the ullage fuel float valve having a stepped configuration and a height H1 slidably mounted to the guide member.

17. The system of claim 16, wherein the air inlet port includes a flared receptacle and a valve seat, the ullage vent float slidably mounted to a guide member and having a stepped configuration and a height H2.

18. The system of claim 15, the fuel tank having a fuel volume and wherein shutting off the refueling occurs when the fuel tank is filled to 95% of the fuel volume.

* * * * *